US008986810B2

(12) United States Patent
Grunden et al.

(10) Patent No.: US 8,986,810 B2
(45) Date of Patent: Mar. 24, 2015

(54) TRAUMA REDUCTION WITHOUT BALLISTIC PERFORMANCE REDUCTION

(71) Applicant: Honeywell International Inc., Morristown, NJ (US)

(72) Inventors: Bradley Grunden, Midlothian, VA (US); James Robert Thagard, Belmont, NC (US); Ashok Bhatnagar, Richmond, VA (US)

(73) Assignee: Honeywell International Inc, Morristown, NJ (US)

( * ) Notice: Subject to any disclaimer, the term of this patent is extended or adjusted under 35 U.S.C. 154(b) by 91 days.

(21) Appl. No.: 13/832,693

(22) Filed: Mar. 15, 2013

(65) Prior Publication Data

US 2014/0272267 A1 Sep. 18, 2014

(51) Int. Cl.

| | |
|---|---|
| ***F41H 1/02*** | (2006.01) |
| ***F41H 1/08*** | (2006.01) |
| ***F41H 5/04*** | (2006.01) |

(52) U.S. Cl.

CPC .. *F41H 1/02* (2013.01); *F41H 1/08* (2013.01); *F41H 5/0485* (2013.01)

USPC ..... 428/105; 428/98; 428/107; 428/156; 428/213; 428/364

(58) Field of Classification Search

CPC .. A41D 13/00; B29K 2223/0683; B32B 5/00; B32B 5/02; B32B 5/022; B32B 5/024; B32B 5/12; F41H 5/0471; F41H 5/0485

USPC ..... 428/105, 107, 156, 213, 364, 98

See application file for complete search history.

(56) References Cited

U.S. PATENT DOCUMENTS

| | | | |
|---|---|---|---|
| 4,868,040 | A | 9/1989 | Hallal et al. |
| 4,883,700 | A | 11/1989 | Harpell et al. |
| 4,916,000 | A | 4/1990 | Li et al. |
| 4,953,234 | A | 9/1990 | Li et al. |
| 5,112,667 | A | 5/1992 | Li et al. |
| 5,124,195 | A | 6/1992 | Harpell et al. |
| 5,187,023 | A | 2/1993 | Prevorsek et al. |
| 5,552,208 | A | 9/1996 | Lin et al. |
| 5,660,913 | A | 8/1997 | Coppage, Jr. |
| 5,972,819 | A | 10/1999 | Cohen |
| 6,012,178 | A | 1/2000 | Schuster et al. |
| 6,203,908 | B1 | 3/2001 | Cohen |
| 6,526,862 | B1 | 3/2003 | Lyons |
| 7,642,206 | B1 | 1/2010 | Bhatnagar et al. |
| 7,648,607 | B2 | 1/2010 | Morin |
| 2001/0053645 | A1 | 12/2001 | Henderson |
| 2003/0037361 | A1 | 2/2003 | Steeghs et al. |
| 2005/0072294 | A1 | 4/2005 | Cohen |
| 2010/0003452 | A1 | 1/2010 | Jongedijk et al. |
| 2010/0275337 | A1 | 11/2010 | Bhatnagar et al. |
| 2011/0256339 | A1 | 10/2011 | Yang et al. |
| 2012/0055326 | A1 | 3/2012 | Cohen |
| 2013/0059496 | A1 * | 3/2013 | Ardiff et al. ..... 442/187 |

FOREIGN PATENT DOCUMENTS

| | | |
|---|---|---|
| EP | 2426454 | 3/2012 |
| RU | 2010154317 | 7/2012 |
| WO | WO2008083457 | 7/2008 |

OTHER PUBLICATIONS

Unpublished U.S. Appl. No. 11/706,719.

* cited by examiner

*Primary Examiner* — Brent O'Hern

(57) ABSTRACT

Ballistic resistant composite articles that are resistant to both backface deformation and ballistic penetration. Multiple composites are attached to each other such that fibers in each adjacent composite are oriented at different angles. Each composite has an areal density of at least about 100 g/m$^2$ wherein the areal density of the strike face composite is greater than half of the total areal density of overall multi-composite article.

20 Claims, No Drawings

TRAUMA REDUCTION WITHOUT BALLISTIC PERFORMANCE REDUCTION

BACKGROUND

1. Technical Field

This technology relates to ballistic resistant composite articles having improved backface deformation resistance as well as superior ballistic penetration resistance.

2. Description of the Related Art

Ballistic resistant articles such as bullet resistant vests, helmets, vehicle panels and structural members of military equipment are typically made from composite armor comprising high strength fibers. High strength fibers conventionally used to fabricate composite armor include polyethylene fibers, aramid fibers such as poly(phenylenediamine terephthalamide), graphite fibers, nylon fibers, glass fibers and the like. For some applications, the fibers are formed into woven or knitted fabrics. For other applications, the fibers are coated with a polymeric binder material and formed into non-woven fabrics.

Various ballistic resistant constructions are known that are useful for the formation of hard or soft armor articles such as helmets, panels and vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of ballistic resistance to high speed projectiles such as bullets, shells, shrapnel and the like.

The two primary measures of anti-ballistic performance of composite armor are ballistic penetration resistance and blunt trauma ("trauma") resistance. A common characterization of ballistic penetration resistance is the $V_{50}$ velocity, which is the experimentally derived, statistically calculated impact velocity at which a projectile is expected to completely penetrate armor 50% of the time and be completely stopped by the armor 50% of the time. For composites of equal areal density (i.e. the weight of the composite armor divided by the surface area) the higher the $V_{50}$ the better the penetration resistance of the composite.

Whether or not a high speed projectile penetrates armor, when the projectile engages the armor the impact also deflects the body armor at the area of impact, potentially causing significant non-penetrating, blunt trauma injuries. The measure of the depth of deflection of body armor due to a bullet impact is known as backface signature ("BFS"), also known in the art as backface deformation or trauma signature. Potentially resulting blunt trauma injuries may be as deadly to an individual as if the bullet had fully penetrated the armor and entered the body. This is especially consequential in the context of helmet armor, where the transient protrusion caused by a stopped bullet can still cross the plane of the skull underneath the helmet and cause debilitating or fatal brain damage. Accordingly, there is a need in the art for ballistic resistant composites having both superior $V_{50}$ ballistic performance as well as low backface signature.

It is known that the $V_{50}$ ballistic performance of fibrous composite armor is directly related to the strength of the constituent fibers of the composite. Increases in fiber strength properties such as tenacity and tensile modulus are known to correlate with an increase in $V_{50}$ velocity. However, a corresponding improvement in backface signature reduction with increased fiber strength properties has not been similarly recognized. Typically, backface deformation reduction has been addressed by coupling high $V_{50}$ fabric composites with energy absorbing backing materials, such as energy mitigating foams or honeycomb materials that absorb impact energy rather than transmitting it to the user. However, such backing materials typically add excessive bulk and/or weight to the armor articles and thus are not well suited for use in body armor applications.

In view of these problems, there is an ongoing need in the art for improved armor solutions that have both superior ballistic penetration resistance as well as low backface signature performance. The invention provides a solution to this need.

SUMMARY

Provided is a ballistic resistant material comprising:

a first composite comprising a plurality of non-woven fibrous plies, said plurality of fibrous plies being consolidated; each of the fibrous plies comprising a plurality of unidirectionally oriented fibers, said fibers having a tenacity of 7 g/denier or more and a tensile modulus of 150 g/denier or more; wherein the unidirectionally oriented fibers in each fibrous ply of the first composite are oriented in a non-parallel longitudinal fiber direction relative to the longitudinal fiber direction of each adjacent ply of said first composite; and a second composite attached to the first composite, which second composite comprises a plurality of non-woven fibrous plies, said plurality of fibrous plies being consolidated; each of the fibrous plies comprising a plurality of unidirectionally oriented fibers, said fibers having a tenacity of 7 g/denier or more and a tensile modulus of 150 g/denier or more; wherein the unidirectionally oriented fibers in each fibrous ply of the second composite are oriented in a non-parallel longitudinal fiber direction relative to the longitudinal fiber direction of each adjacent ply of said second composite;

wherein the longitudinal fiber direction of the fibers in each ply of the first composite is different than the longitudinal fiber direction of the fibers in each ply of the second composite; and wherein the first composite has an areal density of at least about 100 g/m$^2$, the second composite has an areal density of at least about 100 g/m$^2$, and wherein the areal density of the first composite is greater than 50% of the total combined areal density of the first composite and the second composite.

Also provided is a ballistic resistant material comprising:

a first composite comprising a plurality of non-woven fibrous plies, said plurality of fibrous plies being consolidated; each of the fibrous plies comprising a plurality of unidirectionally oriented fibers that are substantially coated with a polymeric binder, said fibers having a tenacity of 7 g/denier or more and a tensile modulus of 150 g/denier or more; wherein the unidirectionally oriented fibers in each fibrous ply of the first composite are oriented in a non-parallel longitudinal fiber direction relative to the longitudinal fiber direction of each adjacent ply of said first composite;

a second composite attached to the first composite, which second composite comprises a plurality of non-woven fibrous plies, said plurality of fibrous plies being consolidated; each of the fibrous plies comprising a plurality of unidirectionally oriented fibers that are substantially coated with a polymeric binder, said fibers having a tenacity of 7 g/denier or more and a tensile modulus of 150 g/denier or more; wherein the unidirectionally oriented fibers in each fibrous ply of the second composite are oriented in a non-parallel longitudinal fiber direction relative to the longitudinal fiber direction of each adjacent ply of said second composite; and a third composite attached to the second composite, which third composite comprises a plurality of non-woven fibrous plies, said plurality of fibrous plies being consolidated; each of the fibrous plies comprising a plurality of unidirectionally oriented fibers that are substantially coated with a polymeric binder, said fibers having a tenacity of 7 g/denier or more and a tensile modulus of 150 g/denier or more; wherein the unidirectionally oriented fibers in each fibrous ply of the third composite are oriented in a non-parallel longitudinal fiber direction relative to the longitudinal fiber direction of each adjacent ply of said third composite; and wherein the longitudinal fiber direction of the fibers in each ply of the first composite is different than the longitudinal fiber direction of the fibers in each ply of the second composite; and wherein the longitudinal fiber direction of the fibers in each ply of the first composite is the same as or different than the longitudinal fiber direction of the fibers in each ply of the third composite; and wherein the first composite has an areal density of at least about 100 g/m$^2$, the second composite has an areal density of at least about 100 g/m$^2$, and the third composite has an areal density of at least about 100 g/m$^2$; and wherein the areal density of the first composite is greater than 50% of the total combined areal density of the first composite, second composite and third composite.

Further provided is a ballistic resistant material comprising:

a first composite comprising a plurality of woven fibrous layers, said plurality of fibrous layers being consolidated; each of the fibrous layers comprising a plurality of fibers having a tenacity of 7 g/denier or more and a tensile modulus of 150 g/denier or more; and a second composite attached to the first composite, which second composite comprises a plurality of woven fibrous layers, said plurality of fibrous layers being consolidated; each of the fibrous layers comprising a plurality of fibers having a tenacity of 7 g/denier or more and a tensile modulus of 150 g/denier or more;

wherein each fiber of each composite has a longitudinal fiber direction and the longitudinal fiber direction of the fibers in each layer of the first composite is different than the longitudinal fiber direction of the fibers in each layer of the second composite; and wherein the first composite has an areal density of at least about 100 g/m$^2$, the second composite has an areal density of at least about 100 g/m$^2$, and wherein the areal density of the first composite is greater than 50% of the total combined areal density of the first composite and the second composite.

DETAILED DESCRIPTION

The invention provides articles that include two or more fibrous composites, each composite comprising a plurality of high strength fibers and optionally a polymeric binder material. The multi-composite articles have superior ballistic penetration resistance and are particularly effective in reducing the extent of backface signature.

Articles having superior ballistic penetration resistance are those which exhibit excellent properties defending against penetration by deformable projectiles, such as bullets, and against penetration of fragments, such as shrapnel. Articles exhibiting low backface signature are those that avoid or minimize blunt trauma injuries. Backface signature is a measure of the depth of deflection of either soft or hard armor into a backing material or into a user body due to a projectile impact. Also known in the art as "backface deformation", "trauma signature" or "blunt force trauma" (terms used interchangeably herein), BFS indicates the potential blunt trauma experienced by the body underneath the armor. The standard method for measuring BFS of soft armor is outlined by NIJ Standard 0101.04, Type IIIA, which identifies a method of transferring the physical deformation of a composite resulting from a non-penetrating projectile impact into a deformable clay backing material held in an open face, box-like fixture. Per the NIJ standard, the armor being tested is secured directly to a front surface of the clay backing and any deformation of the clay resulting from standardized projectile firing conditions is identified and measured. Other methods may be used to measure BFS, but the NIJ standard is conventionally used at the present time to evaluate soft armor composites intended for military use.

As used herein, a "high strength fiber" fiber is one which has a preferred tenacity of at least about 7 g/denier or more, a preferred tensile modulus of at least about 150 g/denier or more, and preferably an energy-to-break of at least about 8 J/g or more, each as measured by ASTM D2256. As used herein, the term "denier" is a unit of linear density equal to the mass in grams per 9000 meters of fiber/yarn. The "tenacity" of a fiber refers to the tensile stress expressed as force (grams) per unit linear density (denier) of an unstressed specimen. The "initial modulus" of a fiber is the property of a material representative of its resistance to deformation. The "tensile modulus" refers to the ratio of the change in tenacity, expressed in grams-force per denier (g/d) to the change in strain, expressed as a fraction of the original fiber length (in/in).

For the purposes of the present invention, a "fiber" is an elongate body the length dimension of which is much greater than the transverse dimensions of width and thickness. The cross-sections of fibers for use in this invention may vary widely, and they may be circular, flat or oblong in cross-section. They also may be of irregular or regular multi-lobal cross-section having one or more regular or irregular lobes projecting from the linear or longitudinal axis of the filament. Thus the term "fiber" includes filaments, ribbons, strips and the like having regular or irregular cross-section. It is preferred that the fibers have a substantially circular cross-section. As used herein, the term "yarn" is defined as a single strand consisting of multiple fibers. A single fiber may be formed from just one filament or from multiple filaments. A fiber formed from just one filament is referred to herein as either a "single-filament" fiber or a "monofilament" fiber, and a fiber formed from a plurality of filaments is referred to herein as a "multifilament" fiber.

A "fiber layer" as used herein may comprise a single-ply of unidirectionally oriented fibers, a plurality of consolidated plies of unidirectionally oriented fibers, a woven fabric, a knitted fabric, a plurality of consolidated woven fabrics or a plurality of consolidated knitted fabrics. A "layer" describes a generally planar arrangement. Each fiber layer will have both an outer top surface and an outer bottom surface. A "single-ply" of unidirectionally oriented fibers comprises an arrangement of fibers that are aligned in a unidirectional, substantially parallel array. This type of fiber arrangement is also known in the art as a "unitape", "unidirectional tape", "UD" or "UDT." As used herein, an "array" describes an orderly arrangement of fibers or yarns, which is exclusive of woven and knitted fabrics, and a "parallel array" describes an orderly, side-by-side, coplanar parallel arrangement of fibers or yarns. The term "oriented" as used in the context of "oriented fibers" refers to the alignment direction of the fibers rather than to stretching of the fibers. The term "fabric" describes structures that may include one or more fiber plies, with or without consolidation/molding of the plies. A non-woven fabric formed from unidirectional fibers typically comprises a plurality of non-woven fiber plies that are stacked on each other in a substantially coextensive fashion and consolidated. When used herein, a "single-layer" structure refers to any monolithic fibrous structure composed of one or more individual plies or individual layers that have been merged by consolidation or molding techniques. The term "composite" refers to combinations of fibers, optionally but preferably with a polymeric binder material.

Particularly suitable high-strength, high tensile modulus fibers include polyolefin fibers, including high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzoxazole (PBO) fibers, polybenzothiazole (PBT) fibers, liquid crystal copolyester fibers, rigid rod fibers such as M5® fibers, and glass fibers, including electric grade fiberglass (E-glass; low alkali borosilicate glass with good electrical properties), structural grade fiberglass (S-glass; a high strength magnesia-alumina-silicate) and resistance grade fiberglass (R-glass; a high strength alumino silicate glass without magnesium oxide or calcium oxide). Each of these fiber types is conventionally known in the art. Also suitable for producing polymeric fibers are copolymers, block polymers and blends of the above materials.

The most preferred fiber types include polyethylene fibers (particularly extended chain polyethylene fibers), aramid fibers, PBO fibers, liquid crystal copolyester fibers, polypropylene fibers (particularly highly oriented extended chain polypropylene fibers), polyvinyl alcohol fibers, polyacrylonitrile fibers, glass fibers and rigid rod fibers, particularly M5® rigid rod fibers. Specifically most preferred are polyethylene fibers and aramid fibers.

In the case of polyethylene, preferred fibers are extended chain polyethylenes having molecular weights of at least 300,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,413,110; 4,536,536; 4,551,296; 4,663,101; 5,006,390; 5,032,338; 5,578,374; 5,736,244; 5,741,451; 5,958,582; 5,972,498; 6,448,359; 6,746,975; 6,969,553; 7,078,099; 7,344,668 and U.S. patent application publication 2007/0231572, all of which are incorporated herein by reference. Particularly preferred fiber types are any of the polyethylene fibers sold under the trademark SPECTRA® from Honeywell International Inc. SPECTRA® fibers are well known in the art. Other useful polyethylene fiber types also include and DYNEEMA® UHMWPE yarns commercially available from Royal DSM N.V. Corporation of Heerlen, The Netherlands.

Preferred aramid (aromatic polyamide) or para-aramid fibers are well known and commercially available, and are described, for example, in U.S. Pat. No. 3,671,542. For example, useful aramid filaments are produced commercially by DuPont under the trademark of KEVLAR®. Also useful in the practice of this invention are poly(m-phenylene isophthalamide) fibers produced commercially by DuPont of Wilmington, Del. under the trademark NOMEX® and fibers produced commercially by Teijin Aramid Gmbh of Germany under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia.

Suitable PBO fibers for the practice of this invention are commercially available and are disclosed for example in U.S. Pat. Nos. 5,286,833, 5,296,185, 5,356,584, 5,534,205 and 6,040,050, each of which is incorporated herein by reference. Suitable liquid crystal copolyester fibers for the practice of this invention are commercially available and are disclosed, for example, in U.S. Pat. Nos. 3,975,487; 4,118,372 and 4,161,470, each of which is incorporated herein by reference, and including VECTRAN® liquid crystal copolyester fibers commercially available from Kuraray Co., Ltd. of Tokyo, Japan. Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and is widely commercially available.

M5® fibers are formed from pyridobisimidazole-2,6-diyl (2,5-dihydroxy-p-phenylene) and were most recently manufactured by Magellan Systems International of Richmond, Va. and are described, for example, in U.S. Pat. Nos. 5,674,969, 5,939,553, 5,945,537, and 6,040,478, each of which is incorporated herein by reference. The term "rigid rod" fibers is not limited to such pyridobisimidazole-based fiber types, and many PBO and aramid fiber varieties are often referred to as rigid rod fibers.

Fiberglass-based composites preferably comprise S-glass fibers, which are impregnated with a thermosetting or thermoplastic polymeric resin, such as a thermosetting epoxy or phenolic resin. Such materials are well known in the art and are commercially available. Preferred examples non-exclusively include S2-Glass® composites commercially available from AGY of Aiken, S.C.; and composites formed from HiPerTex™ E-Glass fibers, commercially available from 3B Fibreglass of Battice, Belgium. Also suitable are composites comprising R-glass fibers, such as those commercially available under the trademark VETROTEX® from Saint-Gobain of Courbevoie, France. Also suitable are combinations of all the above materials, all of which are commercially available.

As stated above, a high strength fiber is one which has a preferred tenacity of about 7 g/denier or more, a preferred tensile modulus of about 150 g/denier or more and a preferred energy-to-break of about 8 J/g or more, each as measured by ASTM D2256. Preferred fibers have a preferred tenacity of about 15 g/denier or more, more preferably about 20 g/denier or more, still more preferably about 25 g/denier or more, still more preferably about 30 g/denier or more, still more preferably about 40 g/denier or more, still more preferably about 45 g/denier or more, and most preferably about 50 g/denier or more. Preferred fibers have a preferred tensile modulus of about 300 g/denier or more, more preferably about 400 g/denier or more, more preferably about 500 g/denier or more, more preferably about 1,000 g/denier or more and most preferably about 1,500 g/denier or more. Preferred fibers also have a preferred energy-to-break of about 15 J/g or more, more preferably about 25 J/g or more, more preferably about 30 J/g or more and most preferably have an energy-to-break of about 40 J/g or more. Methods of forming each of the preferred fiber types having these combined high strength properties are conventionally known in the art.

The fibers may be of any suitable denier. For example, fibers may have a denier of from about 50 to about 5000 denier, more preferably from about 200 to 5000 denier, still more preferably from about 650 to about 3000 denier, and most preferably from about 800 to about 1500 denier. The selection is governed by considerations of ballistic effectiveness and cost. Finer fibers are more costly to manufacture and to weave, but can produce greater ballistic effectiveness per unit weight.

The fibers forming each composite of the invention are preferably, but not necessarily, at least partially coated with a polymeric binder material. The polymeric binder material is also commonly referred to in the art as a polymeric "matrix" material. These terms are conventionally known in the art and describe a material that binds fibers together, either by way of its inherent adhesive characteristics or after being subjected to well known heat and/or pressure conditions. As used herein, a "polymeric" binder or matrix material includes resins and rubber. When present, the polymeric binder/matrix material either partially or substantially coats the individual fibers, preferably substantially coating each of the individual filaments/fibers forming a fiber ply or fiber layer.

Suitable polymeric binder materials include both low tensile modulus, elastomeric materials and high tensile modulus, rigid materials. As used herein throughout, the term tensile modulus means the modulus of elasticity, which for polymeric binder materials is measured by ASTM D638. A low or high modulus binder may comprise a variety of polymeric and non-polymeric materials. For the purposes of this invention, a low modulus elastomeric material has a tensile modulus measured at about 6,000 psi (41.4 MPa) or less according to ASTM D638 testing procedures. A low modulus polymer is preferably an elastomer having a tensile modulus of about 4,000 psi (27.6 MPa) or less, more preferably about 2400 psi (16.5 MPa) or less, still more preferably 1200 psi (8.23 MPa) or less, and most preferably is about 500 psi (3.45 MPa) or less. The glass transition temperature (Tg) of the low modulus elastomeric material is preferably less than about 0° C., more preferably the less than about −40° C., and most preferably less than about −50° C. The low modulus elastomeric material also has a preferred elongation to break of at least about 50%, more preferably at least about 100% and most preferably at least about 300%.

A wide variety of materials and formulations may be utilized as a low modulus polymeric binder. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, fluoroelastomers, silicone elastomers, copolymers of ethylene, polyamides (useful with some fiber types), acrylonitrile butadiene styrene, polycarbonates, and combinations thereof, as well as other low modulus polymers and copolymers curable below the melting point of the fiber. Also useful are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type R-$(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. Also useful are resin dispersions of styrene-isoprene-styrene (SIS) block copolymer sold under the trademark PRINLIN® and commercially available from Henkel Technologies, based in Düsseldorf, Germany. Conventional low modulus polymeric binder polymers employed in ballistic resistant composites include polystyrene-polyisoprene-polystyrene-block copolymers sold under the trademark KRATON® commercially produced by Kraton Polymers.

While low modulus polymeric binder materials are preferred for the formation of flexible armor materials, high modulus polymeric binder materials are preferred for the formation of rigid armor articles. High modulus, rigid materials generally have an initial tensile modulus greater than 6,000 psi. Useful high modulus, rigid polymeric binder materials include polyurethanes (both ether and ester based), epoxies, polyacrylates, phenolic/polyvinyl butyral (PVB) polymers, vinyl ester polymers, styrene-butadiene block copolymers, as well as mixtures of polymers such as vinyl ester and diallyl phthalate or phenol formaldehyde and polyvinyl butyral. A particularly useful rigid polymeric binder material is a thermosetting polymer that is soluble in carbon-carbon saturated solvents such as methyl ethyl ketone, and possessing a high tensile modulus when cured of at least about $1\times10^6$ psi (6895 MPa) as measured by ASTM D638. Particularly useful rigid polymeric binder materials are those described in U.S. Pat. No. 6,642,159, the disclosure of which is incorporated herein by reference.

Most specifically preferred are polar resins or polar polymers, particularly polyurethanes within the range of both soft and rigid materials at a tensile modulus ranging from about 2,000 psi (13.79 MPa) to about 8,000 psi (55.16 MPa). Preferred polyurethanes are applied as aqueous polyurethane dispersions that are most preferably, but not necessarily, cosolvent free. Such includes aqueous anionic polyurethane dispersions, aqueous cationic polyurethane dispersions and aqueous nonionic polyurethane dispersions. Particularly preferred are aqueous anionic polyurethane dispersions; aqueous aliphatic polyurethane dispersions, and most preferred are aqueous anionic, aliphatic polyurethane dispersions, all of which are preferably cosolvent free dispersions. Such includes aqueous anionic polyester-based polyurethane dispersions; aqueous aliphatic polyester-based polyurethane dispersions; and aqueous anionic, aliphatic polyester-based polyurethane dispersions, all of which are preferably cosolvent free dispersions. Such also includes aqueous anionic polyether polyurethane dispersions; aqueous aliphatic polyether-based polyurethane dispersions; and aqueous anionic, aliphatic polyether-based polyurethane dispersions, all of which are preferably cosolvent free dispersions. Similarly preferred are all corresponding variations (polyester-based; aliphatic polyester-based; polyether-based; aliphatic polyether-based, etc.) of aqueous cationic and aqueous nonionic dispersions. Most preferred is an aliphatic polyurethane dispersion having a modulus at 100% elongation of about 700 psi or more, with a particularly preferred range of 700 psi to about 3000 psi. More preferred are aliphatic polyurethane dispersions having a modulus at 100% elongation of about 1000 psi or more, and still more preferably about 1100 psi or more. Most preferred is an aliphatic, polyether-based anionic polyurethane dispersion having a modulus of 1000 psi or more, preferably 1100 psi or more.

When a composite does include a binder, the total weight of the binder comprising the composite preferably comprises from about 2% to about 50% by weight, more preferably from about 5% to about 30%, more preferably from about 7% to about 20%, and most preferably from about 11% to about 16% by weight of the fibers plus the weight of the binder. A lower binder content is appropriate for woven/knitted fabrics, wherein a polymeric binder content of greater than zero but less than 10% by weight of the fibers plus the weight of the binder is typically most preferred, but this is not intended as strictly limiting. For example, phenolic/PVB impregnated woven aramid fabrics are sometimes fabricated with a higher resin content of from about 20% to about 30%, although about 12% content is typically preferred. Whether a low modulus material or a high modulus material, the polymeric binder may also include fillers such as carbon black or silica, may be extended with oils, or may be vulcanized by sulfur, peroxide, metal oxide or radiation cure systems as is well known in the art.

Methods for applying a polymeric binder material to fibers to thereby impregnate fiber plies/layers with the binder are well known and readily determined by one skilled in the art. The term "impregnated" is considered herein as being synonymous with "embedded," "coated," or otherwise applied with a polymeric coating where the binder material diffuses into the fiber ply/layer and is not simply on a surface of the ply/layer. Any appropriate application method may be utilized to apply the polymeric binder material and particular use of a term such as "coated" is not intended to limit the method by which it is applied onto the filaments/fibers. Useful methods include, for example, spraying, extruding or roll coating polymers or polymer solutions onto the fibers, as well as transporting the fibers through a molten polymer or polymer solution. Most preferred are methods that substantially coat or encapsulate each of the individual fibers and cover all or substantially all of the fiber surface area with the polymeric binder material.

The composites of the invention may comprise woven fabrics, non-woven fabrics or knitted fabrics. Woven fabrics may be formed using techniques that are well known in the art using any fabric weave, such as plain weave, crowfoot weave, basket weave, satin weave, twill weave, three dimensional woven fabrics, and any of their several variations. Plain weave is most common, where fibers are woven together in an orthogonal 0°/90° orientation, and is preferred. More preferred are plain weave fabrics having an equal warp and weft count. In one embodiment, a single layer of woven fabric preferably has from about 15 to about 55 fiber/yarn ends per inch (about 5.9 to about 21.6 ends per cm) in both the warp and fill directions, and more preferably from about 17 to about 45 ends per inch (about 6.7 to about 17.7 ends per cm). The fibers/yarns forming the woven fabric preferably have a denier of from about 375 to about 1300. The result is a woven fabric weighing preferably from about 5 to about 19 ounces per square yard (about 169.5 to about 644.1 g/m$^2$), and more preferably from about 5 to about 11 ounces per square yard (about 169.5 to about 373.0 g/m$^2$). Examples of such woven fabrics are those designated as SPECTRA® fabric styles 902, 903, 904, 952, 955 and 960 available from JPS Composite Materials of Anderson, S.C. or other commercial weavers, fabricated with SPECTRA® fibers from Honeywell International Inc. Other exemplary woven fabrics include fabrics formed from basket weaves, such as SPECTRA® fabric style 912. Examples of aramid-based woven fabrics are those designated as KEVLAR® fabric styles 704, 705, 706, 708, 710, 713, 720, 745 and 755 available from DuPont and TWARON® fabric styles 5704, 5716 and 5931, which are commercially available from Kolon Industries, Inc.

Knit fabric structures are constructions composed of intermeshing loops, with the four major types being tricot, raschel, net and oriented structures. Due to the nature of the loop structure, knits of the first three categories are not as suitable as they do not take full advantage of the strength of a fiber. Oriented knitted structures, however, use straight inlaid yarns held in place by fine denier knitted stitches. The yarns are absolutely straight without the crimp effect found in woven fabrics due to the interlacing effect on the yarns. These laid in yarns can be oriented in a monoaxial, biaxial or multi-axial direction depending on the engineered requirements. It is preferred that the specific knit equipment used in laying in the load bearing yarns is such that the yarns are not pierced through.

While not mandatory, the fibers of woven fabrics or knitted fabrics may optionally be coated with a polymeric binder to facilitate merging a plurality of woven/knitted fabric layers or merging with other woven/knitted or non-woven composites of the invention. Typically, weaving or knitting of fabrics is performed prior to coating the fibers with an optional polymeric binder, where the fabrics are thereafter impregnated with the binder. Alternatively, multiple woven fabrics may be interconnected with each other using 3D weaving methods, such as by weaving warp and weft threads into a stack of woven fabrics both horizontally and vertically. A plurality of woven fabrics may also be attached to each other by other means, such as adhesive attachment via an intermediate adhesive film between fabrics, mechanical attachment by stitching/needle punching fabrics together in the z-direction, or a combination thereof. Coating or impregnating woven fabrics with a polymeric binder material or applying an intermediate adhesive film between woven fabric layers is also optional when such 3D weaving methods are employed. Similar techniques may be employed for merging a plurality of knitted fabrics.

Most preferably, a woven composite of the invention is formed by impregnating/coating a plurality of individual woven fabric layers with a polymeric binder followed by stacking a plurality of the impregnated fabrics on each other in a substantially coextensive fashion, and then merging the stack into a single-layer structure by low pressure consolidation or high pressure molding.

Such a woven composite will typically include from about from about 2 to about 100 of these woven fabric layers, more preferably from about 2 to about 85 layers, and most preferably from about 2 to about 65 woven fabric layers. Again, similar techniques and preferences apply to merging a plurality of knitted fabrics.

A non-woven composite of the invention may be formed by conventional methods in the art. For example, in a preferred method of forming a non-woven fabric, a plurality of fibers are arranged into at least one array, typically being arranged as a fiber web comprising a plurality of fibers aligned in a substantially parallel, unidirectional array. In a typical process, fiber bundles are supplied from a creel and led through guides and one or more spreader bars into a collimating comb. This is typically followed by coating the fibers with a polymeric binder material. A typical fiber bundle will have from about 30 to about 2000 individual fibers. The spreader bars and collimating comb disperse and spread out the bundled fibers, reorganizing them side-by-side in a coplanar fashion. Ideal fiber spreading results in the individual filaments or individual fibers being positioned next to one another in a single fiber plane, forming a substantially unidirectional, parallel array of fibers without fibers overlapping each other. Similar to woven fabrics, a single ply of woven fabric preferably has from about 15 to about 55 fiber/yarn ends per inch (about 5.9 to about 21.6 ends per cm), and more preferably from about 17 to about 45 ends per inch (about 6.7 to about 17.7 ends per cm). A 2-ply 0°/90° non-woven fabric will have the same number of fiber/yarn ends per inch in both directions. The fibers/yarns forming the non-woven plies also preferably have a denier of from about 375 to about 1300.

Next, if the fibers are coated, the coating is typically dried followed by forming the coated fibers into a single-ply of a desired length and width. Uncoated fibers may be bound together with an adhesive film, by bonding the fibers together with heat, or any other known method, to thereby form a single-ply. Several of these non-woven, single-plies are then stacked on top of each other in coextensive fashion and merged together.

Most typically, non-woven fabric layers include from 1 to about 6 plies, but may include as many as about 10 to about 20 plies as may be desired for various applications. The greater the number of plies translates into greater ballistic resistance, but also greater weight. A non-woven composite will typically include from about from about 2 to about 100 of these fabric layers, more preferably from about 2 to about 85 layers, and most preferably from about 2 to about 65 non-woven fabric layers. The number of layers in each of the first composite, second composite and any additional composites may be different or may be the same, wherein the layers are of any suitable thickness.

As is conventionally known in the art, excellent ballistic resistance is achieved when individual fiber plies that are coextensively stacked upon each other are cross-plied such that the such that the unidirectionally oriented fibers in each fibrous ply are oriented in a non-parallel longitudinal fiber direction relative to the longitudinal fiber direction of each adjacent ply. Most preferably, the fiber plies are cross-plied orthogonally at 0° and 90° angles, but adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,574; and 4,737,402, all of which are incorporated herein by reference to the extent not incompatible herewith. Typically, the fibers in adjacent plies will be oriented at an angle of from 45° to 90°, preferably 60° to 90°, more preferably 80° to 90° and most preferably at about 90° relative to each other, where the angle of the fibers in alternate layers is preferably substantially the same.

In the preferred embodiments herein, it is preferred that the unidirectionally oriented fibers in each fibrous ply of the first composite are oriented at an angle of 90° or about 90° relative to the longitudinal fiber direction of each adjacent ply of said first composite, and the unidirectionally oriented fibers in each fibrous ply of the second composite are oriented at an angle of 90° or about 90° relative to the longitudinal fiber direction of each adjacent ply of said second composite. The same configuration is preferred for each additional composite of the invention individually.

While the 0°/90° structures described above are preferred for the fabrication of each individual composite, in a multi-composite ballistic resistant material of the invention comprising a plurality of composites, the longitudinal fiber direction of the fibers in each ply of one composite is to be positioned at an angle different than the longitudinal fiber direction of the fibers in each ply of each adjacent composite. Specifically, the longitudinal fiber direction of the fibers in each ply of the first composite is different than the longitudinal fiber direction of the fibers in each ply of the second composite, and the longitudinal fiber direction of the fibers in each ply of the first composite is the same as or different than the longitudinal fiber direction of the fibers in each ply of a third composite. Altering the fiber orientation of each composite relative to the adjacent composites provides additional stiffness which in turn reduces trauma without reducing ballistic penetration resistance effectiveness. As highlighted in the Examples, each of the first composite, second composite and optional third composite (as well as any additional composites) may include groups of sub-layers within the respective composites where the longitudinal fiber direction of the component fiber plies may be at several differing angles relative to each other. This type of embodiment is of particular interest in hybrid articles combining, for example, one or more aramid-based composites with one or more polyethylene-based composites into a single article.

This difference in longitudinal fiber orientation may be virtually any angle between about 0° and about 90° (or between 90° and 180°, depending on how measured). In a preferred two composite embodiment of the invention, the first composite and the second composite are attached to each other such that an outer ply of the first composite is attached to an outer ply of the second composite, and wherein the longitudinal fiber direction of the fibers in the outer ply of the first composite is oriented at an angle of 22.5° or 112.5° relative to the longitudinal fiber direction of the fibers in the outer ply of the second composite. In another embodiment, the first composite and the second composite are attached to each other such that an outer ply of the first composite is attached to an outer ply of the second composite, and wherein the longitudinal fiber direction of the fibers in the outer ply of the first composite is oriented at an angle of 45.0° or 135.0° relative to the longitudinal fiber direction of the fibers in the outer ply of the second composite. In yet another embodiment, the first composite and the second composite are attached to each other such that an outer ply of the first composite is attached to an outer ply of the second composite, and wherein the longitudinal fiber direction of the fibers in the outer ply of the first composite is oriented at an angle of 67.5° or 157.5° relative to the longitudinal fiber direction of the fibers in the outer ply of the second composite. The longitudinal orientation of fibers in said outer plies is preferably substantially the same as the longitudinal orientation of fibers in each alternating fiber ply (i.e. every even numbered ply or every odd numbered ply) within the same composite.

Each of the first composite, second composite and any additional composites of the invention may individually be chemically the same as each other or chemically different than one or more of the other composites. In one embodiment, the fibers and polymeric binder forming the first composite are both chemically the same as the fibers and polymeric binder forming the second composite. For example, each composite may comprise extended chain polyethylene fibers coated with a polyurethane binder. In another embodiment, the fibers and polymeric binder forming the first composite are both chemically different than the fibers and polymeric binder forming the second composite. For example, the first composite may comprise extended chain polyethylene fibers coated with a polyurethane binder while the second composite comprise aramid fibers coated with a polyurethane binder.

In a preferred three composite ($1^{st}/2^{nd}/3^{rd}$) article embodiment, the fibers and polymeric binder forming the first composite are both chemically the same as the fibers and polymeric binder forming each of the second composite and third composite. In another preferred three composite ($1^{st}/2^{nd}/3^{rd}$) article embodiment, the fibers and polymeric binder forming the first composite and third composite are both chemically the same but are different than the fibers and polymeric binder forming the second composite. In yet another three composite ($1^{st}/2^{nd}/3^{rd}$) article embodiment, each composite is formed from different fibers and different polymeric binder materials.

In other embodiments, the fibers of each composite may be the same as each other but the polymeric binder may be different. For example, a first and second composite may each comprise extended chain polyethylene fibers, wherein the first composite (preferably positioned as the strike face of the ballistic resistant material) incorporates a high modulus polymeric binder material and the second composite (positioned behind the first composite) incorporates a low modulus polymeric binder material. In one preferred embodiment, the first composite has a flexural modulus which is at least about 15% higher than the flexural modulus of the second composite, or more preferably 25% higher than the flexural modulus of the second composite.

The composites individually are preferably in the same type of fabric structure (e.g., woven, knitted or non-woven) as each of the other composites in the ballistic resistant material. Alternatively, there may be a combination of different types of fabrics, forming a hybrid structure. In one preferred embodiment, the layers of fibers in each composite are all non-woven fabrics. In another preferred embodiment, the layers of fibers in each composite are all non-woven fabrics comprising all unidirectionally oriented fibers. In another preferred embodiment, the layers of fibers in each composite are all non-woven fabrics comprising all unidirectionally oriented fibers. In still another embodiment, the layers of fibers in the first composite are all non-woven fabrics comprising all unidirectionally oriented fibers, and the layers of fibers in the second composite are all woven fabrics. In yet another embodiment, the layers of fibers in the first composite are all woven fabrics and the layers of fibers in the second composite are all non-woven fabrics comprising all unidirectionally oriented fibers. In three composite ($1^{st}/2^{nd}/3^{rd}$) articles, the first and third composites are preferably the same construction, while the middle second composite may vary in construction.

In still other embodiments, some composites may comprise a greater amount of polymeric binder than other composites, or some composites may comprise a polymeric binder while other composites have no polymeric binder (i.e. are matrix-free). In one specifically preferred two composite article embodiment, the second composite has greater polymeric binder content than the first composite. This embodiment will increase the stiffness of the second composite to therefore reduce trauma.

The type and number of fiber layers also affects the areal density of the composites, and the number of layers forming each composite will vary depending upon the ultimate end use of the desired ballistic resistant article. For example, in body armor vests for military applications, in order to form an article that achieves an areal density of 1.0 lb/ft$^2$ (psf) (4.88 kg/m$^2$ (ksm)), a total of at 22 individual 2-ply (e.g.)0°/90° layers may be required, or 22 woven or knitted fabrics formed from the high-strength fibers described herein. Minimum levels of body armor ballistic resistance for military use are categorized by National Institute of Justice (NIJ) Threat Levels, as is well known in the art.

Each composite of the invention has an areal density of at least 100 g/m$^2$, preferably having an areal density of at least 200 g/m$^2$ and more preferably having an areal density of at least 976 g/m$^2$. Most preferably, each of the first composite, second composite and each additional composite has an areal density of at least 4000 g/m$^2$ (4.0 ksm)(about 0.82 psf). In preferred embodiments, the sum of the first composite, second composite and any additional composites produces a ballistic resistant material having a total combined areal density of from about 0.2 psf (0.976 ksm) to about 8.0 psf (39.04 ksm), more preferably from about 0.3 psf (1.464 ksm) to about 6.0 psf (29.28 ksm), still more preferably from about 0.5 psf (2.44 ksm) to about 5.0 psf (24.4 ksm), still more preferably from about 0.5 psf (2.44 ksm) to about 3.5 psf (17.08 ksm), still more preferably from about 1.0 psf (4.88 ksm) to about 3.0 psf (14.64 ksm), and still more preferably from about 1.5 psf (7.32 ksm) to about 3.0 psf (14.64 ksm). In the most preferred embodiments of the invention, the sum of the first composite, second composite and any additional composites produces a ballistic resistant material having a total combined areal density of 1.62 psf (7.9056 ksm) or greater, more preferably 1.63 psf (7.9544 ksm) or greater, still more preferably 1.64 psf (8.0032 ksm) or greater, and most preferably 1.65 psf (8.052 ksm) or greater.

In use, the first composite is preferably positioned as the front "strike face" of the ballistic resistant material, i.e. the composite that a projectile threat will strike first. In other embodiments, either the second composite, a third composite, or an additional composite may be positioned as the strike face composite, but it is most preferred that the first composite is the strike face composite. For maximum backface signature resistance performance, when the first composite is positioned as the strike face composite, this first composite has an areal density of greater than 50% of the total combined areal density of the first composite and the second composite. Where the ballistic resistant material comprises more than two composites, the areal density of the first composite is greater than 50% of the total combined areal density of all the combined composites. In one embodiment, the areal density of the first composite is greater than about 60% of the total combined areal density of all combined composites. In another embodiment, the areal density of the first composite is greater than about 70% of the total combined areal density of all combined composites. In most preferred two composite embodiments, the first composite comprises from about 60% to about 75% of the total combined areal density of the first composite and the second composite, and the second composite comprises from about 25% to about 40% of the total combined areal density of the first composite and the second composite. In another embodiment, the areal density of the first composite may be equal to the areal density of the second composite, preferably where at least a third composite is included in the ballistic resistant article. In a preferred three composite ($1^{st}/2^{nd}/3^{rd}$) article, the first and third composites combined comprise from about 60% to about 75% of the total combined areal density and the second composite comprises from about 25% to about 40% of the total combined areal density.

In a specifically preferred two composite configuration, the first composite comprises about 75% of the total combined areal density and the second composite comprises about 25% of the total combined areal density. In another specifically preferred two composite configuration, the first composite comprises about 63% of the total combined areal density and the second composite comprises about 37% of the total combined areal density. In a specifically preferred three composite ($1^{st}/2^{nd}/3^{rd}$) configuration, the first and third composites combined comprise about 75% of the total combined areal density and the second composite comprises about 25% of the total combined areal density. In another specifically preferred three composite ($1^{st}/2^{nd}/3^{rd}$) configuration, the first and third composites combined comprise about 63% of the total combined areal density and the second composite comprises about 37% of the total combined areal density. These configurations are specifically preferred because they exhibit a combination of superior ballistic penetration resistance and maximum backface signature resistance performance.

The thickness of each composite will correspond to the thickness of the individual fibers and the number of fiber plies/layers incorporated into the composite. For example, a preferred woven/knitted fabric composite will have a preferred thickness of from about 25 μm to about 600 μm per ply/layer, more preferably from about 50 μm to about 385 μm and most preferably from about 75 μm to about 255 μm per ply/layer. A preferred two-ply non-woven fabric composite will have a preferred thickness of from about 12 μm to about 600 μm, more preferably from about 50 μm to about 385 μm and most preferably from about 75 μm to about 255 μm.

When forming the composites individually, conventional conditions in the art are used to merge the individual plies/layers into single-layer composite structures. As mentioned previously, merging using no pressure or low pressure is often referred to in the art as "consolidation" while high pressure merging is often referred to as "molding," but these terms are frequently used interchangeably. Each stack of overlapping non-woven fiber plies, woven fabric layers or knitted fabric layers is merged under heat and pressure, or by adhering the coatings of individual fiber plies, to form a single-layer, monolithic element. Methods of consolidating fiber plies/layers to form complex composites are well known, such as by the methods described in U.S. Pat. No. 6,642,159. Consolidation can occur via drying, cooling, heating, pressure or a combination thereof. Heat and/or pressure may not be necessary, as the fibers or fabric layers may just be glued together, as is the case in a wet lamination process. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that the polymeric binder coating can be caused to stick or flow without completely melting. However, generally, if the polymeric binder material is caused to melt, relatively little pressure is required to form the composite, while if the binder material is only heated to a sticking point, more pressure is typically required. As is conventionally known in the art, consolidation may be conducted in a calendar set, a flat-bed laminator, a press or in an autoclave. Consolidation may also be conducted by vacuum molding the material in a mold that is placed under a vacuum. Vacuum molding technology is well known in the art. Most commonly, a plurality of orthogonal fiber webs are "glued" together with the binder polymer and run through a flat bed laminator to improve the uniformity and strength of the bond. Further, the consolidation and polymer application/bonding steps may comprise two separate steps or a single consolidation/lamination step.

Alternately, consolidation may be achieved by molding under heat and pressure in a suitable molding apparatus. Generally, molding is conducted at a pressure of from about 50 psi (344.7 kPa) to about 5,000 psi (34,470 kPa), more preferably about 100 psi (689.5 kPa) to about 3,000 psi (20,680 kPa), most preferably from about 150 psi (1,034 kPa) to about 1,500 psi (10,340 kPa). Molding may alternately be conducted at higher pressures of from about 5,000 psi (34,470 kPa) to about 15,000 psi (103,410 kPa), more preferably from about 750 psi (5,171 kPa) to about 5,000 psi, and more preferably from about 1,000 psi to about 5,000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. and most preferably at a temperature from about 200° F. to about 280° F. The pressure under which the fiber layers are molded has a direct effect on the stiffness or flexibility of the resulting molded product. Particularly, the higher the pressure at which they are molded, the higher the stiffness, and vice-versa. In addition to the molding pressure, the quantity, thickness and composition of the fiber plies and polymeric binder coating type also directly affects the stiffness of composite.

While each of the molding and consolidation techniques described herein are similar, each process is different. Particularly, molding is a batch process and consolidation is a generally continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft (flexible) body armor fabrics. Molding is typically reserved for the manufacture of hard armor, e.g. rigid plates. In either process, suitable temperatures, pressures and times are generally dependent on the type of polymeric binder coating materials, polymeric binder content, process used and fiber type.

Thereafter, the first composite, second composite and any additional composites are attached to each other. Useful techniques include those consolidation or molding techniques described previously, where the composites are placed together into a flat-bed laminator, press or autoclave and merged. When the composites are fabricated with a polymeric binder material, the binder may serve as an adhesive for binding the composites to each other. Alternatively, whether or not the composites comprise a binder, the composites may be attached to each other using a separate adhesive. Suitable adhesives non-exclusively include elastomeric materials such as polyethylene, cross-linked polyethylene, chlorosulfonated polyethylene, ethylene copolymers, polypropylene, propylene copolymers, polybutadiene, polyisoprene, natural rubber, ethylene-propylene copolymers, ethylene-propylene-diene terpolymers, polysulfide polymers, polyurethane elastomers, polychloroprene, plasticized polyvinylchloride using one or more plasticizers that are well known in the art (such as dioctyl phthalate), butadiene acrylonitrile elastomers, poly (isobutylene-co-isoprene), polyacrylates, polyesters, unsaturated polyesters, polyethers, fluoroelastomers, silicone elastomers, copolymers of ethylene, thermoplastic elastomers, phenolics, polybutyrals, epoxy polymers, styrenic block copolymers, such as styrene-isoprene-styrene or styrene-butadiene-styrene types, and other suitable adhesive compositions conventionally known in the art. Particularly preferred adhesives include methacrylate adhesives, cyanoacrylate adhesives, UV cure adhesives, urethane adhesives, epoxy adhesives and blends of the above materials. Of these, an adhesive comprising a polyurethane thermoplastic adhesive, particularly a blend of one or more polyurethane thermoplastics with one or more other thermoplastic polymers, is preferred. Most preferably, the adhesive comprises polyether aliphatic polyurethane. Such adhesives may be applied, for example, in the form of a hot melt, film, paste or spray, or as a two-component liquid adhesive.

Other suitable means for direct attachment of the elements non-exclusively includes stitching them together, as well as bolting them or screwing them together such that their surfaces contact each other. In a preferred embodiment, the composites are attached to each other with an adhesive and also reinforced in the z-direction by conventional needle-punching methods. Utilizing both means of attachment will increase inter-laminar strength between composites which will translate to higher stiffness and reduced trauma.

It is also within the scope of the invention that the individual layers of each individual composite may remain unconsolidated, followed by consolidating/molding a unit comprising multiple unconsolidated composite sections together in a single step. In this embodiment, each of the individual sections may optionally be stitched together to maintain their integrity prior to this single unitary consolidation/molding step.

The composites of the invention may also optionally comprise one or more thermoplastic polymer layers attached to one or both of their outer surfaces. Suitable polymers for the thermoplastic polymer layer non-exclusively include polyolefins, polyamides, polyesters (particularly polyethylene terephthalate (PET) and PET copolymers), polyurethanes, vinyl polymers, ethylene vinyl alcohol copolymers, ethylene octane copolymers, acrylonitrile copolymers, acrylic polymers, vinyl polymers, polycarbonates, polystyrenes, fluoropolymers and the like, as well as co-polymers and mixtures thereof, including ethylene vinyl acetate (EVA) and ethylene acrylic acid. Also useful are natural and synthetic rubber polymers. Of these, polyolefin and polyamide layers are preferred. The preferred polyolefin is a polyethylene. Non-limiting examples of useful polyethylenes are low density polyethylene (LDPE), linear low density polyethylene (LLDPE), medium density polyethylene (MDPE), linear medium density polyethylene (LMDPE), linear very-low density polyethylene (VLDPE), linear ultra-low density polyethylene (ULDPE), high density polyethylene (HDPE) and co-polymers and mixtures thereof. Also useful are SPUNFAB® polyamide webs commercially available from Spunfab, Ltd, of Cuyahoga Falls, Ohio (trademark registered to Keuchel Associates, Inc.), as well as THERMOPLAST™ and HELIOPLAST™ webs, nets and films, commercially available from Protechnic S.A. of Cernay, France.

Any thermoplastic polymer layers are preferably very thin, having preferred layer thicknesses of from about 1 μm to about 250 μm, more preferably from about 5 μm to about 25 μm and most preferably from about 5 μm to about 9 μm. Discontinuous webs such as SPUNFAB® non-woven webs are preferably applied with a basis weight of 6 grams per square meter (gsm). While such thicknesses are preferred, it is to be understood that other thicknesses may be produced to satisfy a particular need and yet fall within the scope of the present invention.

Such thermoplastic polymer layers may be bonded to the composite surfaces using well known techniques, such as thermal lamination. Typically, laminating is done by positioning the individual layers on one another under conditions of sufficient heat and pressure to cause the layers to combine into a unitary structure. Lamination may be conducted at temperatures ranging from about 95° C. to about 175° C., preferably from about 105° C. to about 175° C., at pressures ranging from about 5 psig (0.034 MPa) to about 100 psig (0.69 MPa), for from about 5 seconds to about 36 hours, preferably from about 30 seconds to about 24 hours. Such thermoplastic polymer layers may alternatively be bonded to the composite surfaces with hot glue or hot melt fibers as would be understood by one skilled in the art.

The ballistic resistant articles of the invention are particularly suitable for any body armor application that requires low backface deformation, i.e. optimal blunt trauma resistance, including flexible, soft armor articles as well as rigid, hard armor articles, as well as for the defense of vehicles and structural elements, such as building walls. When employed, the ballistic resistant articles of the invention should be oriented so that the first composite is positioned as the strike face of the article.

The following examples serve to illustrate the invention.

EXAMPLES

Ballistic testing was performed on various multi-composite articles to determine the affect of composite composition and fiber layer orientation on both ballistic penetration resistance ($V_{50}$) and backface signature performance. Seventeen different composite article configurations were fabricated comprising various combinations of polyethylene fiber-reinforced composites and aramid fiber-reinforced composites, with each configuration having varying proportions of each composite type and with varying fiber layer orientations for each composite type.

Each polyethylene fiber-reinforced composite layer was fabricated from four cross-plied, non-woven polyethylene fiber plies in a 0°/90°/0°/90° configuration, with the fibers in adjacent plies being longitudinally oriented at 90° (or at approximately 90°) to each other and consolidated into a monolithic layer (i.e., 0°/90°/0°/90° or)90°/0°/90°/0°. Each ply was individually formed from an array of unidirectionally oriented, parallel polyethylene fibers coated with a polyurethane binder. The tenacity of the polyethylene fibers was 37 g/denier and the resin content in each fiber ply was ca. 16%. The polyurethane binder was of a proprietary composition. The fibers and binder used to fabricate each ply of each polyethylene fiber-reinforced composite were the same.

Each aramid fiber-reinforced composite layer was fabricated from four cross-plied, non-woven aramid fiber plies in a 0°/90°/0°/90° configuration, with the fibers in adjacent plies being longitudinally oriented at 90° (or at approximately) 90° to each other and consolidated into a monolithic layer (i.e., 0°/90°/0°/90° or) 90°/0°/90°/0°. Each ply was individually formed from an array of unidirectionally oriented, parallel aramid fibers coated with a polyurethane binder. The aramid fibers were 1000 denier KEVLAR® 129 fibers having a tenacity of 23 g/denier, and the resin content in each fiber ply was 18.5%. The polyurethane binder was an anionic, aliphatic polyester-based polyurethane. The fibers and binder in each ply of the second composite were the same.

To form the individual layers, the plies were stacked on top of each other coextensively and consolidated under heat and pressure. The consolidation temperature was from about 220° F. (104.4° C.) to about 250° F. (121.1° C.) and the consolidation pressure was approximately 100 psi (689.5 kPa).

The desired number of layers of each type required to assemble each desired configuration were provided as 0°/90°/0°/90° squares having a length of 25" and a width of 25". The layers were stacked onto each other coextensively with each fiber layer in the stack being positioned on top of the previous fiber layer so that the longitudinal orientation of the fibers in each fiber ply varied as identified below. The plurality of layers were then merged together into a monolithic article by molding in a platen press at 2777 psi (19.15 MPa) for 15 minutes at 280° F. (137.77° C.), with the composites first being pre-heated to 280° F. for 10 minutes under contact pressure only. For some configurations where indicated below, a separate adhesive film was incorporated between a polyethylene fiber-reinforced composite and an aramid fiber-reinforced composite to enhance bond strength. After pressing, the articles were then cooled to below 100° F. (37.8° C.), removed from the press, cut into four squares having a length of 12" and a width of 12" and subjected to ballistic testing.

Backface Signature Measurement

Ballistic testing was performed with a desired surface of each article positioned as a strike face composite that received the initial projectile impact with the remaining layers positioned behind the strike face composite. For each example, BFS was measured against a 9 mm, 124-grain FMJ RN projectile fired at a velocity of about 1430 feet/second (fps)±30 fps. 25"×25" samples were fabricated for each article configuration, and subsequently cut down to four 12"×12" squares and subjected to ballistic testing. Two of these squares were tested for 9 mm BFS by impacting each one in the center of the four quadrants of the panel. Accordingly, the BFS data is reported in Table 1 as an average of the eight clay deformation measurements determinations for each sample. The backface signature data was measured with the multi-composite article being spaced apart from a clay block by ½ inch (12.7 mm) by inserting a custom machined spacer element between the composite article and the clay block. The custom machined spacer element comprised an element having a border and an interior cavity defined by said border wherein the clay was exposed through the cavity, and wherein the spacer was positioned in direct contact with front surface of the clay. High velocity projectiles were fired at the composite articles at target locations corresponding to the interior cavity of the spacer. The projectiles impacted the composite article at locations corresponding to the interior cavity of the spacer, and each projectile impact caused a measurable depression in the clay. All of the BFS measurements refer only to the depth of the depression in the clay as per this method and do not take into account the depth of the spacer element (i.e. the BFS measurements in do not include the actual distance between the composite and the clay). This method is similar to the method of NIJ Standard 0101.04, Type IIIA, but that method requires placement of the composite article directly on a flat clay block. The testing apparatus and method are described in greater detail in commonly-owned U.S. patent application Ser. No. 13/594,757, which is incorporated herein by reference.

$V_{50}$ Measurement

For each example, $V_{50}$ was measured against a V50 against a 16-grain Right Circular Cylinder (RCC) projectile fired at a velocity of at least about 3200 feet/sec (fps) (975.36 m/s). $V_{50}$ data was acquired under conventionally known standardized techniques, particularly per the conditions of Department of Defense Test Method Standard MIL-STD-662F. The two remaining 12"×12" samples for each article configuration were subjected to the 16 grain RCC $V_{50}$ testing. Each sample was shot four times and the $V_{50}$ data is reported in Table 2 as an average of all eight $V_{50}$ determinations.

Delamination Measurement

Delamination in Table 2 refers to the post test measurement of the depth of rear deformation of the actual tested panels, rather than the depth of depression in the backing material. Such is referred to as "delamination" because it is not the clay depression which is being measured. This measurement of delamination will be less than the BFS measurement plus the ½" (12.7 mm) air gap depth because after a projectile impact, the fabric at the area of impact partially retracts. The delamination measurement is taken after said retraction, while the BFS measurement with the air gap method described herein records the full extent of rear deformation of the fabric. Deformation after said retraction is typically measured by cutting a cross-section of the panel and measuring the depth from the plane of the undamaged rear surface of the panel to the deepest outer portion of the deformed area.

Examples 1 and 2 (Comparative)

Article Configuration 1

31 four-ply layers of the polyethylene fiber-reinforced fabric, with all odd plies having the same longitudinal fiber orientation and all even plies having the same longitudinal fiber orientation.

Total areal density of Article Configuration 1: 1.63 lb/ft$^2$ (7.95 kg/m$^2$ (ksm)).

Examples 3 and 4

Article Configuration 2

(A) 23 four-ply layers of the polyethylene fiber-reinforced composite, with all odd plies having the same longitudinal fiber orientation and all even plies having the same longitudinal fiber orientation;

(B) 2 four-ply layers of the polyethylene fiber-reinforced composite, with all odd plies having a longitudinal fiber orientation at 22.5° relative to the 0° ply of (A) and all even plies having a longitudinal fiber orientation at 112.5° relative to the 0° ply of (A);

(C) 2 four-ply layers of the polyethylene fiber-reinforced composite, with all odd plies having a longitudinal fiber orientation at 45.0° relative to the 0° ply of (A) and all even plies having a longitudinal fiber orientation at 135.0° relative to the 0° ply of (A);

(D) 2 four-ply layers of the polyethylene fiber-reinforced composite, with all odd plies having a longitudinal fiber orientation at 67.5° relative to the 0° ply of (A) and all even plies having a longitudinal fiber orientation at 157.5° relative to the 0° ply of (A); and (E) 2 four-ply layers of the polyethylene fiber-reinforced composite, with all odd plies having a longitudinal fiber orientation at 90.0° relative to the 0° ply of (A) and all even plies having a longitudinal fiber orientation at 0° relative to the 0° ply of (A).

Total areal density of Article Configuration 2: 1.63 lb/ft$^2$ (7.95 ksm).

Examples 5 and 6

Article Configuration 3

(A) First (Strike Face) Composite: 26 four-ply layers of the aramid fiber-reinforced composite, with all odd plies having the same longitudinal fiber orientation and all even plies having the same longitudinal fiber orientation;

(B) Second Composite: 8 four-ply layers of the polyethylene fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A); and (C) Third Composite: 2 four-ply layers of the aramid fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A).

Total areal density of Article Configuration 3: 1.67 lb/ft$^2$ (8.15 ksm).

Examples 7-8

Article Configuration 4

(A) First (Strike Face) Composite: 26 four-ply layers of the aramid fiber-reinforced composite, with all odd plies having the same longitudinal fiber orientation and all even plies having the same longitudinal fiber orientation;

(B) Second Composite: 8 four-ply layers of the polyethylene fiber-reinforced composite, with all odd plies having a longitudinal fiber orientation at 45.0° relative to the 0° ply of the strike face composite (A) and all even plies having a longitudinal fiber orientation at 135.0° relative to the 0° ply of the strike face composite (A); and (C) Third Composite: 2 four-ply layers of the aramid fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A).

Total areal density of Article Configuration 4: 1.67 lb/ft$^2$ (8.15 ksm).

Examples 9 and 10

Article Configuration 5

(A) First (Strike Face) Composite: 26 four-ply layers of the aramid fiber-reinforced composite, with all odd plies having the same longitudinal fiber orientation and all even plies having the same longitudinal fiber orientation;

(B) 4-mil thick thermoplastic polyurethane adhesive film commercially available from Adhesives Films, Inc. Pine Brook, N.J.;

(C) Second Composite: 8 four-ply layers of the polyethylene fiber-reinforced composite, with all odd plies having a longitudinal fiber orientation at 45.0° relative to the 0° ply of the strike face composite (A) and all even plies having a longitudinal fiber orientation at 135.0° relative to the 0° ply of the strike face composite (A);

(D) 4-mil thick thermoplastic polyurethane adhesive film commercially available from Adhesives Films, Inc. Pine Brook, N.J.; and (E) Third Composite: 2 four-ply layers of the aramid fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A).

Total areal density of Article Configuration 5: 1.67 lb/ft$^2$ (8.15 ksm).

Examples 11 and 12

Article Configuration 6

This sample was identical to Article Configuration 5 except the adhesive films used between the composites were NOLAX® A21.2007 and NOLAX® A21.2017 films commercially available from Nolax AG of Switzerland. The A21.2007 is an EVA-based film and was positioned against the PE-based composite. The A21.2017 film was positioned against the aramid-based composite. The A21.2017 film includes an EVA layer coextruded with a polyurethane layer. The EVA layer was next to the A21.2007 film while the polyurethane layer was next to the aramid-based composite.

Total areal density of Article Configuration 6: 1.67 lb/ft$^2$ (8.15 ksm).

Examples 13 and 14

Article Configuration 7

(A) First (Strike Face) Composite: 26 four-ply layers of the aramid fiber-reinforced composite, with all odd plies having the same longitudinal fiber orientation and all even plies having the same longitudinal fiber orientation;

(B) Second Composite:

(i) 2 four-ply layers of the polyethylene fiber-reinforced composite, with all odd plies having a longitudinal fiber orientation at 22.5° relative to the 0° ply of the strike face composite (A) and all even plies having a longitudinal fiber orientation at 112.5° relative to the 0° ply of the strike face composite (A);

(ii) 2 four-ply layers of the polyethylene fiber-reinforced composite, with all odd plies having a longitudinal fiber orientation at 45.0° relative to the 0° ply of the strike face composite (A) and all even plies having a longitudinal fiber orientation at 135.0° relative to the 0° ply of the strike face composite (A);

(iii) 2 four-ply layers of the polyethylene fiber-reinforced composite, with all odd plies having a longitudinal fiber orientation at 67.5° relative to the 0° ply of the strike face composite (A) and all even plies having a longitudinal fiber orientation at 157.5° relative to the 0° ply of the strike face composite (A); and (iv) 2 four-ply layers of the polyethylene fiber-reinforced composite, with all odd plies having a longitudinal fiber orientation at 90.0° relative to the 0° ply of the strike face composite (A) and all even plies having a longitudinal fiber orientation at 0° relative to the 0° ply of the strike face composite (A); and (C) Third Composite: 2 four-ply layers of the aramid fiber-reinforced composite, with all odd plies having a longitudinal fiber orientation at 112.5° relative to the 0° ply of the strike face composite (A) and all even plies having a longitudinal fiber orientation at 22.5° relative to the 0° ply of the strike face composite (A).

Total areal density of Article Configuration 7: 1.67 lb/ft$^2$ (8.15 ksm).

Examples 15 and 16

Article Configuration 8

(A) First (Strike Face) Composite:

(i) 2 four-ply layers of the aramid fiber-reinforced composite, with all odd plies having a longitudinal fiber orientation at 45.0° relative to the 0° ply of (A)(iii) and all even plies having a longitudinal fiber orientation at 135.0° relative to the 0° ply of (A)(iii);

(ii) 2 four-ply layers of the aramid fiber-reinforced composite, with all odd plies having a longitudinal fiber orientation at 22.5° relative to the 0° ply of (A)(iii) and all even plies having a longitudinal fiber orientation at 112.5° relative to the 0° ply of (A)(iii); and (iii) 22 four-ply layers of the aramid fiber-reinforced composite, with all odd plies having the same longitudinal fiber orientation and all even plies having the same longitudinal fiber orientation; and (B) Second Composite: 8 four-ply layers of the polyethylene fiber-reinforced composite, with all odd plies having a longitudinal fiber orientation at 0° relative to the 0° ply of (A)(iii) and all even plies having a longitudinal fiber orientation at 90° relative to the 0° ply of (A)(iii); and (C) Third composite: 2 four-ply layers of the aramid fiber-reinforced composite, with all odd plies having a longitudinal fiber orientation at 0° relative to the 0° ply of (A)(iii) and all even plies having a longitudinal fiber orientation at 90° relative to the 0° ply of (A)(iii).

Total areal density of Article Configuration 8: 1.67 lb/ft$^2$ (8.15 ksm).

Examples 17 and 18

Article Configuration 9

(A) First (Strike Face) Composite:

(i) 2 four-ply layers of the aramid fiber-reinforced composite, with all odd plies having a longitudinal fiber orientation at 90° relative to the 0° ply of (A)(v) and all even plies having a longitudinal fiber orientation at 0° relative to the 0° ply of (A)(v);

(ii) 2 four-ply layers of the aramid fiber-reinforced composite, with all odd plies having a longitudinal fiber orientation at 67.5° relative to the 0° ply of (A)(v) and all even plies having a longitudinal fiber orientation at 157.5° relative to the 0° ply of (A)(v);

(iii) 2 four-ply layers of the aramid fiber-reinforced composite, with all odd plies having a longitudinal fiber orientation at 45.0° relative to the 0° ply of (A)(v) and all even plies having a longitudinal fiber orientation at 135.0° relative to the 0° ply of (A)(v);

(iv) 2 four-ply layers of the aramid fiber-reinforced composite, with all odd plies having a longitudinal fiber orientation at 22.5° relative to the 0° ply of (A)(v) and all even plies having a longitudinal fiber orientation at 112.5° relative to the 0° ply of (A)(v); and (v) 18 four-ply layers of the aramid fiber-reinforced composite, with all odd plies having the same longitudinal fiber orientation and all even plies having the same longitudinal fiber orientation; and (B) Second Composite: 8 four-ply layers of the polyethylene fiber-reinforced composite, with all odd plies having a longitudinal fiber orientation at 0° relative to the 0° ply of (A)(v) and all even plies having a longitudinal fiber orientation at 90° relative to the 0° ply of (A)(v); and (C) Third Composite: 2 four-ply layers of the aramid fiber-reinforced composite, with all odd plies having a longitudinal fiber orientation at 0° relative to the 0° ply of (A)(v) and all even plies having a longitudinal fiber orientation at 90° relative to the 0° ply of (A)(v).

Total areal density of Article Configuration 9: 1.67 lb/ft$^2$ (8.15 ksm).

Examples 19 and 20

Article Configuration 10

In this sample, the First Composite was identical to that of Article Configuration 9 and further included the following composites merged after (A)(v):

(B) Second Composite:

(i) 2 four-ply layers of the polyethylene fiber-reinforced composite, with all odd plies having a longitudinal fiber orientation at 22.5° relative to the 0° ply of (A)(v) and all even plies having a longitudinal fiber orientation at 112.5° relative to the 0° ply of (A)(v);

(ii) 2 four-ply layers of the polyethylene fiber-reinforced composite, with all odd plies having a longitudinal fiber orientation at 45.0° relative to the 0° ply of (A)(v) and all even plies having a longitudinal fiber orientation at 135.0° relative to the 0° ply of (A)(v);

(iii) 2 four-ply layers of the polyethylene fiber-reinforced composite, with all odd plies having a longitudinal fiber orientation at 67.5° relative to the 0° ply of (A)(v) and all even plies having a longitudinal fiber orientation at 157.5° relative to the 0° ply of (A)(v); and (iv) 2 four-ply layers of the polyethylene fiber-reinforced composite, with all odd plies having a longitudinal fiber orientation at 90° relative to the 0° ply of (A)(v) and all even plies having a longitudinal fiber orientation at 0° relative to the 0° ply of (A)(v); and (C) Third Composite: 2 four-ply layers of the aramid fiber-reinforced composite, with all odd plies having a longitudinal fiber orientation at 112.5° relative to the 0° ply of (A)(v) and all even plies having a longitudinal fiber orientation at 22.5° relative to the 0° ply of (A)(v).

Total areal density of Article Configuration 10: 1.67 lb/ft$^2$ (8.15 ksm).

Examples 21 and 22

Article Configuration 11

(A) First (Strike Face) Composite: 22 four-ply layers of the aramid fiber-reinforced composite, with all odd plies having the same longitudinal fiber orientation and all even plies having the same longitudinal fiber orientation;

(B) Second Composite: 11 four-ply layers of the polyethylene fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A); and (C) Third Composite: 2 four-ply layers of the aramid fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A).

Total areal density of Article Configuration 11: 1.65 lb/ft$^2$ (8.05 ksm).

Examples 23 and 24

Article Configuration 12

(A) First (Strike Face) Composite: 22 four-ply layers of the aramid fiber-reinforced composite, with all odd plies having the same longitudinal fiber orientation and all even plies having the same longitudinal fiber orientation;

(B) Second Composite:

(i) 4 four-ply layers of the polyethylene fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A); and (ii) 7 four-ply layers of the polyethylene fiber-reinforced composite, with all odd plies having a longitudinal fiber orientation at 45.0° relative to the 0° ply of the strike face composite (A) and all even plies having a longitudinal fiber orientation at 135.0° relative to the 0° ply of the strike face composite (A); and (C) Third Composite: 2 four-ply layers of the aramid fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A).

Total areal density of Article Configuration 12: 1.65 lb/ft$^2$ (8.05 ksm).

Examples 25 and 26

Article Configuration 13

(A) First (Strike Face) Composite: 22 four-ply layers of the aramid fiber-reinforced composite, with all odd plies having the same longitudinal fiber orientation and all even plies having the same longitudinal fiber orientation;

(B) 4-mil thick thermoplastic polyurethane adhesive film commercially available from Adhesives Films, Inc. Pine Brook, N.J.;

(C) Second Composite:

(i) 4 four-ply layers of the polyethylene fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A); and (ii) 7 four-ply layers of the polyethylene fiber-reinforced composite, with all odd plies having a longitudinal fiber orientation at 45.0° relative to the 0° ply of the strike face composite (A) and all even plies having a longitudinal fiber orientation at 135.0° relative to the 0° ply of the strike face composite (A); and (D) 4-mil thick thermoplastic polyurethane adhesive film commercially available from Adhesives Films, Inc. Pine Brook, N.J.; and (E) Third Composite: 2 four-ply layers of the aramid fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A).

Total areal density of Article Configuration 13: 1.65 lb/ft$^2$ (8.05 ksm).

Examples 27 and 28

Article Configuration 14

(A) First (Strike Face) Composite: 22 four-ply layers of the aramid fiber-reinforced composite, with all odd plies having the same longitudinal fiber orientation and all even plies having the same longitudinal fiber orientation;

(B) Second Composite:

(i) 4 four-ply layers of the polyethylene fiber-reinforced composite, with all odd plies having a longitudinal fiber orientation at 0° relative to the 0° ply of the strike face composite (A) and all even plies having a longitudinal fiber orientation at 90° relative to the 0° ply of the strike face composite (A);

(ii) 2 four-ply layers of the polyethylene fiber-reinforced composite, with all odd plies having a longitudinal fiber orientation at 22.5° relative to the 0° ply of the strike face composite (A) and all even plies having a longitudinal fiber orientation at 112.5° relative to the 0° ply of the strike face composite (A);

(iii) 2 four-ply layers of the polyethylene fiber-reinforced composite, with all odd plies having a longitudinal fiber orientation at 45.0° relative to the 0° ply of the strike face composite (A) and all even plies having a longitudinal fiber orientation at 135.0° relative to the 0° ply of the strike face composite (A);

(iv) 2 four-ply layers of the polyethylene fiber-reinforced composite, with all odd plies having a longitudinal fiber orientation at 67.5° relative to the 0° ply of the strike face composite (A) and all even plies having a longitudinal fiber orientation at 157.5° relative to the 0° ply of the strike face composite (A); and (v) 1 four-ply layers of the polyethylene fiber-reinforced composite, with all odd plies having a longitudinal fiber orientation at 90° relative to the 0° ply of the strike face composite (A) and all even plies having a longitudinal fiber orientation at 0° relative to the 0° ply of the strike face composite (A); and (C) Third Composite: 2 four-ply layers of the aramid fiber-reinforced composite, with all odd plies having a longitudinal fiber orientation at 112.5° relative to the 0° ply of the strike face composite (A) and all even plies having a longitudinal fiber orientation at 22.5° relative to the 0° ply of the strike face composite (A).

Total areal density of Article Configuration 14: 1.65 lb/ft$^2$ (8.05 ksm).

Examples 29 and 30

Article Configuration 15

(A) First (Strike Face) Composite:

(i) 2 four-ply layers of the aramid fiber-reinforced composite, with all odd plies having a longitudinal fiber orientation at 45.0° relative to the 0° ply of (A)(iii) and all even plies having a longitudinal fiber orientation at 135.0° relative to the 0° ply of (A)(iii);

(ii) 2 four-ply layers of the aramid fiber-reinforced composite, with all odd plies having a longitudinal fiber orientation at 22.5° relative to the 0° ply of (A)(iii) and all even plies having a longitudinal fiber orientation at 112.5° relative to the 0° ply of (A)(iii); and (iii) 18 four-ply layers of the aramid fiber-reinforced composite, with all odd plies having the same longitudinal fiber orientation and all even plies having the same longitudinal fiber orientation; and (B) Second Composite: 11 four-ply layers of the polyethylene fiber-reinforced composite, with all odd plies having a longitudinal fiber orientation at 0° relative to the 0° ply of (A)(iii) and all even plies having a longitudinal fiber orientation at 90° relative to the 0° ply of (A)(iii); and (C) Third Composite: 2 four-ply layers of the aramid fiber-reinforced composite, with all odd plies having a longitudinal fiber orientation at 0° relative to the 0° ply of (A)(iii) and all even plies having a longitudinal fiber orientation at 90° relative to the 0° ply of (A)(iii).

Total areal density of Article Configuration 15: 1.65 lb/ft$^2$ (8.05 ksm).

Examples 31 and 32

Article Configuration 16

(A) First (Strike Face) Composite:

(i) 2 four-ply layers of the aramid fiber-reinforced composite, with all odd plies having a longitudinal fiber orientation at 90° relative to the 0° ply of (A)(v) and all even plies having a longitudinal fiber orientation at 0° relative to the 0° ply of (A)(v);

(ii) 2 four-ply layers of the aramid fiber-reinforced composite, with all odd plies having a longitudinal fiber orientation at 67.5° relative to the 0° ply of the of (A)(v) and all even plies having a longitudinal fiber orientation at 157.5° relative to the 0° ply of the of (A)(v);

(iii) 2 four-ply layers of the aramid fiber-reinforced composite, with all odd plies having a longitudinal fiber orientation at 45.0° relative to the 0° ply of (A)(v) and all even plies having a longitudinal fiber orientation at 135.0° relative to the 0° ply of (A)(v);

(iv) 2 four-ply layers of the aramid fiber-reinforced composite, with all odd plies having a longitudinal fiber orientation at 22.5° relative to the 0° ply of (A)(v) and all even plies having a longitudinal fiber orientation at 112.5° relative to the 0° ply of (A)(v); and (v) 14 four-ply layers of the aramid fiber-reinforced composite, with all odd plies having the same longitudinal fiber orientation and all even plies having the same longitudinal fiber orientation; and (B) Second Composite: 11 four-ply layers of the polyethylene fiber-reinforced composite, with all odd plies having a longitudinal fiber orientation at 0° relative to the 0° ply of (A)(v) and all even plies having a longitudinal fiber orientation at 90° relative to the 0° ply of (A)(v); and (C) Third Composite: 2 four-ply layers of the aramid fiber-reinforced composite, with all odd plies having a longitudinal fiber orientation at 0° relative to the 0° ply of (A)(v) and all even plies having a longitudinal fiber orientation at 90° relative to the 0° ply of (A)(v).

Total areal density of Article Configuration 16: 1.65 lb/ft$^2$ (8.05 ksm).

Examples 33 and 34

Article Configuration 17

In this sample, the First Composite was identical to that of Article Configuration 16 and further included the following composites merged after (A)(v):

(B) Second Composite:

(i) 4 four-ply layers of the polyethylene fiber-reinforced composite, with all odd plies having a longitudinal fiber orientation at 90° relative to the 0° ply of (A)(v) and all even plies having a longitudinal fiber orientation at 0° relative to the 0° ply of (A)(v);

(ii) 2 four-ply layers of the polyethylene fiber-reinforced composite, with all odd plies having a longitudinal fiber orientation at 22.5° relative to the 0° ply of (A)(v) and all even plies having a longitudinal fiber orientation at 112.5° relative to the 0° ply of (A)(v);

(iii) 2 four-ply layers of the polyethylene fiber-reinforced composite, with all odd plies having a longitudinal fiber orientation at 45.0° relative to the 0° ply of (A)(v) and all even plies having a longitudinal fiber orientation at 135.0° relative to the 0° ply of (A)(v);

(iv) 2 four-ply layers of the polyethylene fiber-reinforced composite, with all odd plies having a longitudinal fiber orientation at 67.5° relative to the 0° ply of (A)(v) and all even plies having a longitudinal fiber orientation at 157.5° relative to the 0° ply of (A)(v); and (v) 1 four-ply layers of the polyethylene fiber-reinforced composite, with all odd plies having a longitudinal fiber orientation at 90° relative to the 0° ply of (A)(v) and all even plies having a longitudinal fiber orientation at 0° relative to the 0° ply of (A)(v); and (C) Third Composite: 2 four-ply layers of the aramid fiber-reinforced composite, with all odd plies having a longitudinal fiber orientation at 112.5° relative to the 0° ply of (A)(v) and all even plies having a longitudinal fiber orientation at 22.5° relative to the 0° ply of (A)(v).

Total areal density of Article Configuration 17: 1.65 lb/ft$^2$ (8.05 ksm).

TABLE 1

| EXAMPLE | ARTICLE CONFIG. | AVERAGE BFS (mm) | BFS % Change |
|---|---|---|---|
| 1 & 2 (Controls) | 1 | 14.75 | NA |
| 3 & 4 | 2 | 10.25 | −30.51 |
| 5 & 6 (Controls) | 3 | 1.625 | NA |
| 7 & 8 | 4 | 0.625 | −61.54 |
| 9 & 10 | 5 | 0.75 | −53.85 |
| 11 & 12 | 6 | 0.125 | −92.31 |
| 13 & 14 | 7 | 0.375 | −76.92 |
| 15 & 16 | 8 | 2 | 23.08 |
| 17 & 18 | 9 | 1.375 | −15.38 |
| 19 & 20 | 10 | 1.125 | −30.77 |
| 21 & 22 (Controls) | 11 | 3.125 | NA |
| 23 & 24 | 12 | 1.375 | −56 |
| 25 & 26 | 13 | 1.125 | −64 |
| 27 & 28 | 14 | 1.625 | −48 |
| 29 & 30 | 15 | 5.5 | 76 |
| 31 & 32 | 16 | 6.25 | 100 |
| 33 & 34 | 17 | 2.75 | −12 |

TABLE 2

| EXAMPLE | ARTICLE CONFIG. | AVERAGE $V_{50}$ (ft/sec) | $V_{50}$ % Change | AVERAGE Delam (mm) |
|---|---|---|---|---|
| 1 & 2 (Controls) | 1 | 2835 | NA | 12.25 |
| 3 & 4 | 2 | 2782 | −1.88 | 12.875 |
| 5 & 6 (Controls) | 3 | 2407 | NA | 6.625 |
| 7 & 8 | 4 | — | — | 7.125 |
| 9 & 10 | 5 | 2239 | −6.98 | 5.625 |
| 11 & 12 | 6 | 2195 | −8.81 | 5.875 |
| 13 & 14 | 7 | 2163 | −10.14 | 7.125 |
| 15 & 16 | 8 | 2250 | −6.52 | 7.25 |
| 17 & 18 | 9 | 2276 | −5.44 | 7.5 |
| 19 & 20 | 10 | 2270 | −5.69 | 6.5 |
| 21 & 22 (Controls) | 11 | 2449 | NA | 7.25 |
| 23 & 24 | 12 | 2341 | −4.41 | 7.625 |
| 25 & 26 | 13 | 2391 | −2.37 | 6.75 |
| 27 & 28 | 14 | 2313 | −5.55 | 8.5 |
| 29 & 30 | 15 | 2435 | −0.57 | 7.625 |
| 31 & 32 | 16 | 2412 | −1.51 | 8 |
| 33 & 34 | 17 | 2216 | −9.51 | 9.25 |

CONCLUSIONS

As proven by the data in Tables 1 and 2, 9 mm BFS performance is clearly improved (i.e. depth of deformation is reduced) in hybrid articles combining aramid-based composites with polyethylene-based composites into a single article, and the performance is further improved by manipulating fiber layer orientation relative to the longitudinal fiber directions.

Comparing configurations 1 and 2, both are 1.67 psf panels of the same material, but configuration 2 has the last 25% of the panel rotated with every two product layers rotated 22.5°. This configuration improved 9 mm BFS performance by 30% (30% reduction in measured 9 mm BFS) with extremely little impact on the $V_{50}$ performance (1.8% change in configuration 2). Similar effects are seen in hybrid aramid-PE composites. Configurations 3-10 consist of approximately 75% aramid-based composite hybridized with 25% PE-based composite with configuration 3 being used as the control.

Comparing configuration 3 with that of configuration 1, the data shows that hybridization improved 9 mm BFS performance by 89% (an 89% reduction in measured 9 mm BFS) with only a 15% reduction in $V_{50}$ performance. A comparison of configurations 3-10 illustrates the influence of shifting layer orientation and location of the shifted layers on overall 9 mm BFS and $V_{50}$ performance. Configurations 4-7 contained shifted layers in the back half (25% by weight) of the panel only, while configurations 8 and 9 had shifted layers in the front half (10% and 22% by weight, respectively) of the panel only. Configuration 10 was a hybrid having shifted layers in the front and back half of the panel respectively. Comparing configurations 4, 5, 6 and 7 with that of configuration 3, the 9 mm BFS of panels containing shifted layers in the back half (up to 25% by weight) had 9 mm BFS improvements of between 54% and 93% (reductions in measured BFS), with only a 10.1% reduction in $V_{50}$.

In configuration 8, only the initial 10% by weight of the front of the panel consisted of shifted layers. In this case, the measured 9 mm BFS was worse than the control panel of configuration 3. Configuration 9 illustrates that increasing the amount of layers shifted on the strike face to approximately 22% will reduce the measured 9 mm BFS below that of the control (Configuration 3), but not as low as that achieved by shifting the orientation of the layers in the back half of the panel. $V_{50}$ performance of configurations 8 and 9 fall between that observed for control configuration 3 and panels that were constructed by shifting the orientation of the layers in the back half of the panel (Configurations 4-7).

Configuration 10 has both front and back layers shifted. It is similar to configuration 7 but has approximately 22% by weight of its front facing layers shifted in addition to the back half of the panel being shifted. Configuration 10 resulted in a slightly lower 9 mm BFS measurement than configuration 9, showing that shifting the orientation of the backing layers provides additional improvement to BFS performance. A comparison of configurations 7 and 9 indicates that BFS performance improvement was greatest when shifting the orientation of the layers in the back half of the panel construction without shifting the orientation of the layers in the front half.

The data also illustrates that: 1) shifting the orientation of the layers in the back half (25% by weight) of the panel at 22.5° increments for every two layers of product appears more effective in reducing measured 9 mm BFS than shifting the orientation of the back 25% by weight of the panel by 45°; and 2) the use of the NOLAX® adhesive (A21.2007+A21.2017) between the different composite types (aramid & PE) improved the measured 9 mm BFS performance compared to panels that did not utilize the adhesive (see configuration 6 vs. configuration 4). Similar trends were also seen for configurations 11-17.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant material comprising:

a first composite comprising a plurality of non-woven fibrous plies, said plurality of fibrous plies being consolidated; each of the fibrous plies comprising a plurality of unidirectionally oriented fibers, said fibers having a tenacity of 7 g/denier or more and a tensile modulus of 150 g/denier or more; wherein the unidirectionally oriented fibers in each fibrous ply of the first composite are oriented in a non-parallel longitudinal fiber direction relative to the longitudinal fiber direction of each adjacent ply of said first composite; and a second composite attached to the first composite, which second composite comprises a plurality of non-woven fibrous plies, said plurality of fibrous plies being consolidated; each of the fibrous plies comprising a plurality of unidirectionally oriented fibers, said fibers having a tenacity of 7 g/denier or more and a tensile modulus of 150 g/denier or more; wherein the unidirectionally oriented fibers in each fibrous ply of the second composite are oriented in a non-parallel longitudinal fiber direction relative to the longitudinal fiber direction of each adjacent ply of said second composite;

wherein the longitudinal fiber direction of the fibers in each ply of the first composite is different than the longitudinal fiber direction of the fibers in each ply of the second composite; and wherein the first composite has an areal density of at least about 100 g/m$^2$, the second composite has an areal density of at least about 100 g/m$^2$, and wherein the areal density of the first composite is greater than 50% of the total combined areal density of the first composite and the second composite.

2. The ballistic resistant material of claim 1 wherein the unidirectionally oriented fibers in each fibrous ply of the first composite are oriented at an angle of 90° or about 90° relative to the longitudinal fiber direction of each adjacent ply of said first composite, and the unidirectionally oriented fibers in each fibrous ply of the second composite are oriented at an angle of 90° or about 90° relative to the longitudinal fiber direction of each adjacent ply of said second composite.

3. The ballistic resistant material of claim 2 wherein the first composite and the second composite are attached to each other such that an outer ply of the first composite is attached to an outer ply of the second composite, and wherein the longitudinal fiber direction of the fibers in the outer ply of the first composite is oriented at an angle of 22.5° or 112.5° relative to the longitudinal fiber direction of the fibers in the outer ply of the second composite.

4. The ballistic resistant material of claim 2 wherein the first composite and the second composite are attached to each other such that an outer ply of the first composite is attached to an outer ply of the second composite, and wherein the longitudinal fiber direction of the fibers in the outer ply of the first composite is oriented at an angle of 45.0° or 135.0° relative to the longitudinal fiber direction of the fibers in the outer ply of the second composite.

5. The ballistic resistant material of claim 2 wherein the first composite and the second composite are attached to each other such that an outer ply of the first composite is attached to an outer ply of the second composite, and wherein the longitudinal fiber direction of the fibers in the outer ply of the first composite is oriented at an angle of 67.5° or 157.5° relative to the longitudinal fiber direction of the fibers in the outer ply of the second composite.

6. The ballistic resistant material of claim 1 wherein the areal density of the first composite is greater than 60% of the total combined areal density of the first composite and the second composite.

7. The ballistic resistant material of claim 1 wherein the areal density of the first composite is greater than 70% of the total combined areal density of the first composite and the second composite.

8. The ballistic resistant material of claim 1 wherein the fibers of the first composite and the fibers of the second composite are substantially coated with a polymeric binder.

9. The ballistic resistant material of claim 8 wherein the first composite has a flexural modulus which is at least about 15% higher than the flexural modulus of the second composite.

10. The ballistic resistant material of claim 8 wherein the first composite has a flexural modulus which is at least about 25% higher than the flexural modulus of the second composite.

11. The ballistic resistant material of claim 8 wherein the fibers and the polymeric binder forming the first composite are both chemically the same as the fibers and the polymeric binder forming the second composite.

12. The ballistic resistant material of claim 11 wherein the first composite comprises from about 60% to about 75% of the total combined areal density of the first composite and the second composite, and the second composite comprises from about 25% to about 40% of the total combined areal density of the first composite and the second composite.

13. The ballistic resistant material of claim 8 wherein the fibers and polymeric binder forming the first composite are both chemically different than the fibers and polymeric binder forming the second composite.

14. The ballistic resistant material of claim 8 wherein the second composite has greater polymeric binder content than the first composite.

15. The ballistic resistant material of claim 1 wherein the first composite and second composite are attached to each other via an intermediate adhesive film between the first composite and the second composite.

16. The ballistic resistant material of claim 1 wherein the first composite and second composite are attached to each other by both adhesive bonding and needle punching.

17. A ballistic resistant material comprising:

a first composite comprising a plurality of non-woven fibrous plies, said plurality of fibrous plies being consolidated; each of the fibrous plies comprising a plurality of unidirectionally oriented fibers that are substantially coated with a polymeric binder, said fibers having a tenacity of 7 g/denier or more and a tensile modulus of 150 g/denier or more; wherein the unidirectionally oriented fibers in each fibrous ply of the first composite are oriented in a non-parallel longitudinal fiber direction relative to the longitudinal fiber direction of each adjacent ply of said first composite;

a second composite attached to the first composite, which second composite comprises a plurality of non-woven fibrous plies, said plurality of fibrous plies being consolidated; each of the fibrous plies comprising a plurality of unidirectionally oriented fibers that are substantially coated with a polymeric binder, said fibers having a tenacity of 7 g/denier or more and a tensile modulus of 150 g/denier or more; wherein the unidirectionally oriented fibers in each fibrous ply of the second composite are oriented in a non-parallel longitudinal fiber direction relative to the longitudinal fiber direction of each adjacent ply of said second composite; and a third composite attached to the second composite, which third composite comprises a plurality of non-woven fibrous plies, said plurality of fibrous plies being consolidated; each of the fibrous plies comprising a plurality of unidirectionally oriented fibers that are substantially coated with a polymeric binder, said fibers having a tenacity of 7 g/denier or more and a tensile modulus of 150 g/denier or more; wherein the unidirectionally oriented fibers in each fibrous ply of the third composite are oriented in a non-parallel longitudinal fiber direction relative to the longitudinal fiber direction of each adjacent ply of said third composite; and wherein the longitudinal fiber direction of the fibers in each ply of the first composite is different than the longitudinal fiber direction of the fibers in each ply of the second composite; and wherein the longitudinal fiber direction of the fibers in each ply of the first composite is the same as or different than the longitudinal fiber direction of the fibers in each ply of the third composite; and wherein the first composite has an areal density of at least about 100 g/m$^2$, the second composite has an areal density of at least about 100 g/m$^2$, and the third composite has an areal density of at least about 100 g/m$^2$; and wherein the areal density of the first composite is greater than 50% of the total combined areal density of the first composite, second composite and third composite.

18. The ballistic resistant material of claim 17 wherein the fibers and the polymeric binder forming the first composite are both chemically the same as the fibers and the polymeric binder forming the third composite;

wherein the fibers and polymeric binder forming the first composite are both chemically different than the fibers and polymeric binder forming the second composite;

wherein the first composite and the second composite are attached to each other such that an outer ply of the first composite is attached to an outer ply of the second composite, and wherein the longitudinal fiber direction of the fibers in the outer ply of the first composite is oriented at an angle of 22.5°/112.5°, or 45.0°/135.0° or 67.5°/157.5° relative to the longitudinal fiber direction of the fibers in the outer ply of the second composite; and wherein the second composite and the third composite are attached to each other such that an outer ply of the second composite is attached to an outer ply of the third composite, and wherein the longitudinal fiber direction of the fibers in the outer ply of the second composite is oriented at an angle of 22.5°/112.5°, or 45.0°/135.0° or 67.5°/157.5° relative to the longitudinal fiber direction of the fibers in the outer ply of the third composite.

19. A ballistic resistant material comprising:

a first composite comprising a plurality of woven fibrous layers, said plurality of fibrous layers being consolidated; each of the fibrous layers comprising a plurality of fibers having a tenacity of 7 g/denier or more and a tensile modulus of 150 g/denier or more; and a second composite attached to the first composite, which second composite comprises a plurality of woven fibrous layers, said plurality of fibrous layers being consolidated; each of the fibrous layers comprising a plurality of fibers having a tenacity of 7 g/denier or more and a tensile modulus of 150 g/denier or more;

wherein each fiber of each composite has a longitudinal fiber direction and the longitudinal fiber direction of the fibers in each layer of the first composite is different than the longitudinal fiber direction of the fibers in each layer of the second composite; and wherein the first composite has an areal density of at least about 100 g/m$^2$, the second composite has an areal density of at least about 100 g/m$^2$, and wherein the areal density of the first composite is greater than 50% of the total combined areal density of the first composite and the second composite.

20. The panel of claim 19 wherein the fibers of the first composite and the fibers of the second composite are substantially coated with a polymeric binder; wherein the first composite and the second composite are attached to each other such that an outer ply of the first composite is attached to an outer ply of the second composite, and wherein the longitudinal fiber direction of the fibers in the outer ply of the first composite is oriented at an angle of 22.5°/112.5°, or 45.0°/135.0° or 67.5°/157.5° relative to the longitudinal fiber direction of the fibers in the outer ply of the second composite; and wherein the first composite comprises from about 60% to about 75% of the total combined areal density of the first composite and the second composite, and the second composite comprises from about 25% to about 40% of the total combined areal density of the first composite and the second composite.

* * * * *